US008929556B2

(12) United States Patent
Nakano

(10) Patent No.: US 8,929,556 B2
(45) Date of Patent: Jan. 6, 2015

(54) AUDIO-SIGNAL PROCESSING DEVICE AND METHOD FOR PROCESSING AUDIO SIGNAL

(75) Inventor: Kenji Nakano, Kanagawa (JP)

(73) Assignee: Sony Corporation, Tokyo (JP)

( * ) Notice: Subject to any disclaimer, the term of this patent is extended or adjusted under 35 U.S.C. 154(b) by 868 days.

(21) Appl. No.: 12/858,532

(22) Filed: Aug. 18, 2010

(65) Prior Publication Data

US 2011/0051936 A1 Mar. 3, 2011

(30) Foreign Application Priority Data

Aug. 27, 2009 (JP) ..... 2009-197000

(51) Int. Cl.
*H04R 5/00* (2006.01)
*H04R 5/04* (2006.01)
*H04S 7/00* (2006.01)

(52) U.S. Cl.
CPC *H04R 5/04* (2013.01); *H04S 7/302* (2013.01); *H04S 2400/01* (2013.01); *H04S 2400/11* (2013.01); *H04S 2420/01* (2013.01); *H04S 2420/05* (2013.01); *H04S 2420/07* (2013.01)
USPC ..... 381/17; 381/300

(58) Field of Classification Search
CPC ..... H04S 2400/01; H04S 2400/11; H04S 2420/01; H04S 2420/05; H04S 2420/07; H04S 7/302
USPC ..... 381/1, 17–23, 104–107, 300, 310, 309; 700/94
See application file for complete search history.

(56) References Cited

U.S. PATENT DOCUMENTS

| | | | | |
|---|---|---|---|---|
| 5,708,719 | A * | 1/1998 | Greenberger et al. | 381/18 |
| 6,026,169 | A * | 2/2000 | Fujimori | 381/61 |
| 7,110,588 | B2 * | 9/2006 | Dewaele et al. | 382/132 |
| 7,441,630 | B1 * | 10/2008 | Herrington et al. | 181/199 |
| 8,194,898 | B2 * | 6/2012 | Yokota | 381/310 |
| 2004/0234088 | A1 * | 11/2004 | McCarty et al. | 381/306 |
| 2006/0262937 | A1 * | 11/2006 | Kobayashi | 381/27 |
| 2008/0060502 | A1 * | 3/2008 | Hasebe | 84/609 |
| 2008/0101631 | A1 * | 5/2008 | Jung et al. | 381/307 |

FOREIGN PATENT DOCUMENTS

| | | | |
|---|---|---|---|
| JP | 62-021400 | A | 1/1987 |
| JP | 62-145935 | A | 6/1987 |
| JP | 2001-144656 | A | 5/2001 |
| WO | WO 01/24577 | A1 * | 4/2001 |
| WO | WO 2008/047833 | A1 | 4/2008 |

* cited by examiner

*Primary Examiner* — Lun-See Lao
(74) *Attorney, Agent, or Firm* — Wolf, Greenfield & Sacks, P.C.

(57) ABSTRACT

An audio-signal processing device that processes an audio signal and supplies the audio signal to an audio output unit includes a characteristic-component extraction unit that extracts at least a high frequency component contained in the audio signal as a characteristic component. The audio signal and the extracted characteristic component are supplied to the audio output unit so that a sound image of the extracted characteristic component is localized closer to a listener than a sound image of the audio signal.

18 Claims, 8 Drawing Sheets

AUDIO-SIGNAL PROCESSING DEVICE AND METHOD FOR PROCESSING AUDIO SIGNAL

BACKGROUND OF THE INVENTION

1. Field of the Invention

The present invention relates to an audio-signal processing device and a method for processing an audio signal.

2. Description of the Related Art

With the practical use of three-dimensional display devices that realize stereoscopic imagery by allowing each eye of a viewer to see a different image, there is an increasing possibility for stereoscopic video content to be widely used as home-use video content. The three-dimensional display devices present video images with great depth that make viewers feel close to or far away from objects in the video images or feel as if they are watching from different perspectives.

SUMMARY OF THE INVENTION

However, sound accompanying stereoscopic video content is provided in a general format, such as 2-channel and 5.1-channel, which fails to fully produce sound effects suitable for the depth of the video image. In addition, not only sounds for the stereoscopic video content but also usual sounds often lack auditory depth, and therefore, sounds that more greatly enhance depth perception are sometimes in demand.

Thus, the present invention provides an audio-signal processing device capable of presenting sounds rich in auditory depth and a method for processing an audio signal.

According to an embodiment of the present invention, provided is an audio-signal processing device that processes an audio signal and supplies the audio signal to an audio output unit. The audio-signal processing device includes a characteristic-component extraction unit that extracts at least a high frequency component contained in the audio signal as a characteristic component, and supplies the audio signal and extracted characteristic component to the audio output unit to localize a sound image of the extracted characteristic component closer to a listener than a sound image of the audio signal.

According to the structure, the audio signals are output, while the characteristic component corresponding to high and low frequency sounds, which are distinctive in a sound recorded on-mic, are extracted from the audio signals and then output so as to localize the sound image of the characteristic component closer to the listener than the sound image of the audio signal, thereby providing a sound rich in auditory depth.

In addition, the above-described audio-signal processing device may further include a proximity localization processing unit that performs a proximity localization process on the extracted characteristic component to localize the sound image of the extracted characteristic component closer to the listener than the sound image of the audio signal. In this device, the characteristic component having been subjected to the proximity localization process is supplied to the audio output unit instead of the extracted characteristic component.

Furthermore, the above-described audio-signal processing device may further include a characteristic-component attenuation unit that attenuates a characteristic component contained in the audio signal, and may supply the attenuated audio signal and extracted characteristic component to the audio output unit so that the sound image of the extracted characteristic component is localized closer to the listener than the sound image of the audio signal and a sound image of the attenuated audio signal is localized further away from the listener than the sound image of the audio signal.

Furthermore, the above-described audio-signal processing device may further include a separate localization processing unit that performs a separate localization process on the attenuated audio signal to localize the sound image of the attenuated audio signal further away from the listener than the sound image of the audio signal. In this device, the audio signal having been subjected to the separate localization process is supplied to the audio output unit instead of the attenuated audio signal. The separate localization processing unit may delay the attenuated audio signal by a predetermined amount of time with respect to the audio signal.

Furthermore, in the characteristic-component extraction unit, a condition for extracting the characteristic component may be variably controlled in response to an operating instruction made by the listener. In the proximity localization processing unit, a condition of the proximity localization process for the characteristic component may be variably controlled in response to an operating instruction made by the listener. In the characteristic-component attenuation unit, a condition for attenuating the audio signal may be variably controlled in response to an operating instruction made by the listener. In the separate localization processing unit, a condition of the separate localization process for the audio signal may be variably controlled in response to an operating instruction made by the listener.

In addition, the audio signal to be input may be a multi-channel signal, and input of the multi-channel signal may be controlled so that a signal of a channel designated by the listener is input to the characteristic-component extraction unit.

Furthermore, according to another embodiment of the invention, provided is a method for processing an audio signal including the steps of extracting at least a high frequency component from the audio signal as a characteristic component and supplying the audio signal and the extracted characteristic component to an audio output unit to localize a sound image of the extracted characteristic component closer to a listener than a sound image of the audio signal.

According to the above-described embodiments of the invention, an audio-signal processing device capable of presenting sounds rich in auditory depth and a method for processing an audio signal can be provided.

DESCRIPTION OF THE PREFERRED EMBODIMENTS

With reference to the drawings, preferred embodiments of the present invention will be described below. Throughout the specification and drawings, components that substantially have the same functional structure are denoted by the same numerals/characters and repeated description thereof will be omitted.

Figure 1A:
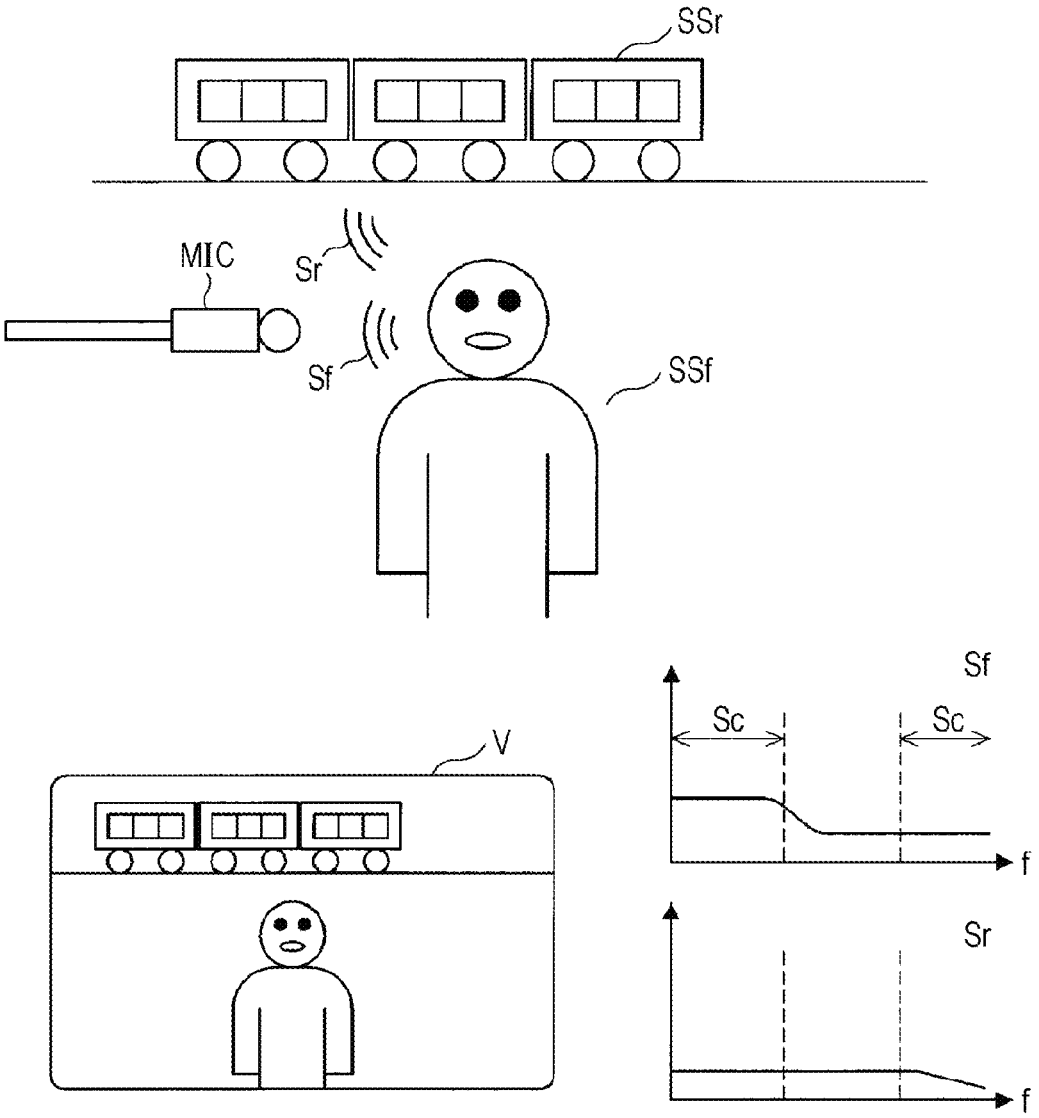
FIG. 1A illustrates a situation where sounds accompanying video content are recorded.
Figure 1B:
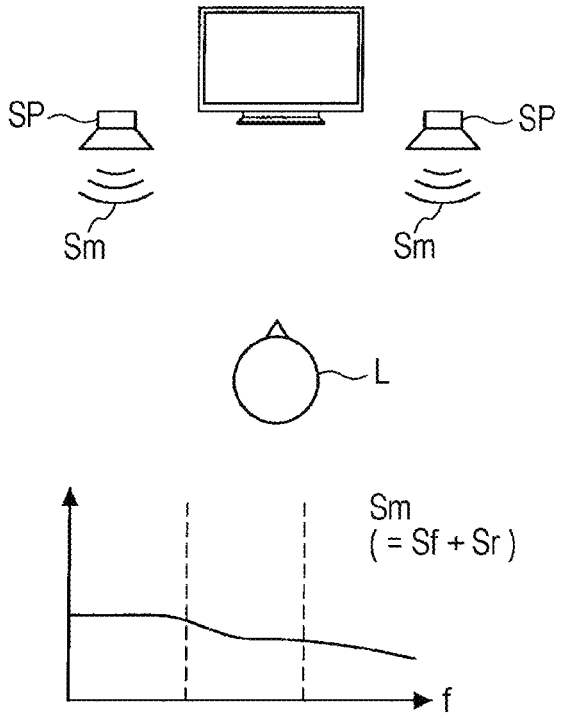
FIG. 1B illustrates a situation where the sounds accompanying the video content are reproduced.

FIGS. 1A and 1B illustrate situations where sounds accompanying video content are recorded and reproduced. As shown in FIG. 1A, in general video content production, a sound Sf (person's dialogue etc.) from a sound source SSf on the front side of a video image V is recorded on-mic by a microphone MIC placed adjacent to the sound source SSf, while a sound Sr (ambient sound etc.) from a sound source SSr on the rear side of the video image V is recorded off-mic.

The sound Sf on the front side tends to maintain a high level in all frequency ranges, and especially, tends to be recorded at high levels in low frequency ranges with the adjacent microphone (proximity effect). The sound Sr on the rear side tends to be recorded at low levels in all frequency ranges, and especially, tends to drop down to a low level in a high frequency range. A signal component corresponding to sounds at a high frequency and low frequency, which dominate a large part of the sound Sf on the front side, can be defined as a characteristic component Sc of the audio signal.

The recorded sounds Sf and Sr are stored and reproduced in the form of a synthesized sound Sm. If the sound Sm is a 2-channel signal, 5.1-channel signal or a signal having another format, the sound is stored as sounds Sm1, Sm2 . . . corresponding to each channel. Upon playback of the stereoscopic video content, as shown in FIG. 1B, the sound image of the sound Sm made by synthesizing the front-side sound Sf and rear-side sound Sr is just localized in front of speakers SP, resulting in reproduction of sounds acoustically poor in depth.

To prevent this, an embodiment of the invention outputs an audio signal as well as extracts a characteristic component Sc of the audio signal, the characteristic component Sc corresponding to high and low frequency sounds which are distinctive in the sound recorded on-mic, and outputs it so as to localize a sound image of the characteristic component Sc closer to the listener L than a sound image of the audio signal. In this manner, localization of the sound close to the listener emphasizes near sound, thereby providing sounds rich in auditory depth.

Referring now to the drawings, an embodiment of the present invention will be described below. The embodiment describes an example in which the present invention is applied to an optical-disc reproduction apparatus 1 capable of reproducing a sound accompanying a stereoscopic video image. However, the present invention can be applied, in addition to the optical-disc reproduction apparatus 1, to television receivers and multimedia devices such as personal computers capable of reproducing sounds accompanying stereoscopic video images. Furthermore, the present invention is not limited to the reproduction of sounds accompanying stereoscopic video images, but can be also applied to reproduction of sounds accompanying usual video images or sounds not accompanying video images.

[1. Structure of Reproduction Apparatus 1]

Figure 2:
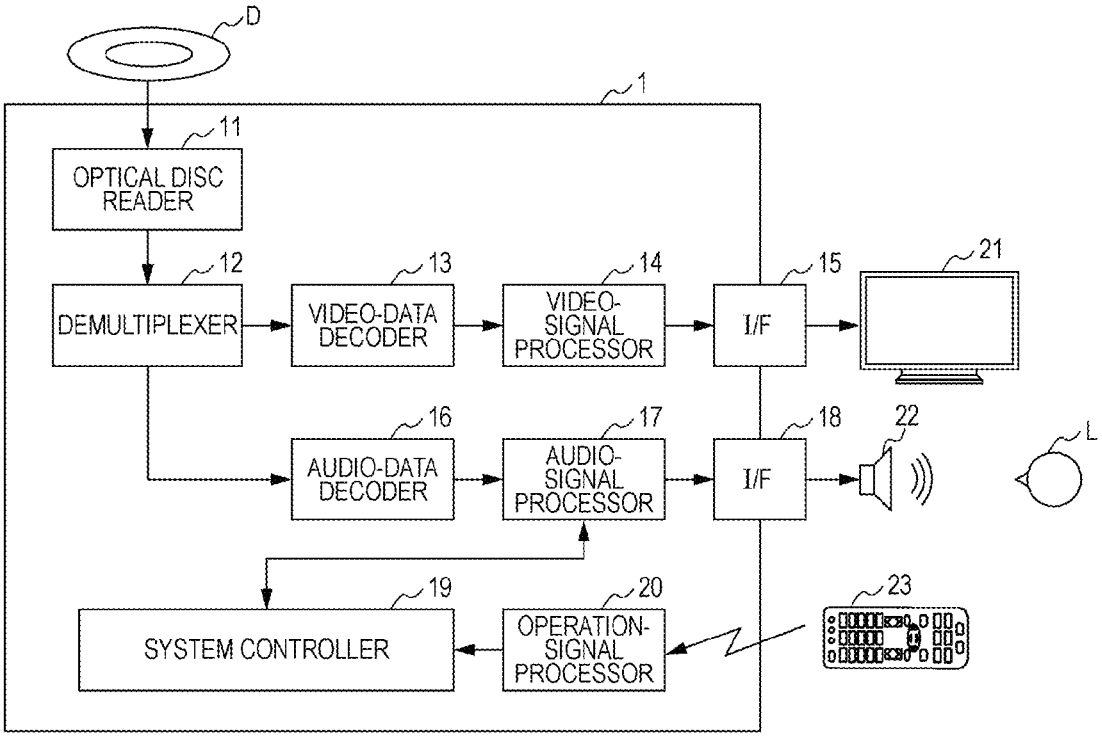
FIG. 2 is a block diagram illustrating the basic structure of a reproduction apparatus according to an embodiment of the invention.

FIG. 2 is a block diagram illustrating the basic structure of a reproduction apparatus 1 according to an embodiment of the present invention.

The reproduction apparatus 1 includes an optical disc reader 11, a demultiplexer 12, a video-data decoder 13, a video-signal processor 14, a video-signal interface 15, an audio-data decoder 16, an audio-signal processor 17 (audio-signal processing device), an audio-signal interface 18, a system controller 19 and an operation-signal processor 20. The reproduction apparatus 1 is connected to a three-dimensional display 21 and a speaker 22 through the video-signal interface 15 and audio-signal interface 18. In addition, the reproduction apparatus 1 is remotely controlled through a remote controller 23.

The optical disc reader 11 includes a loader for loading an optical disc D, a rotation driver, an optical pick-up, a thread motor, a servo circuit and some other components. The optical disc reader 11 reads out multiplexed data (video data, audio data, etc.) recorded on the optical disc D by radiating a laser beam onto the loaded optical disc D and receiving the light beam reflected off the optical disc D, subjects the data to predetermined processing, and feeds the processed data to the demultiplexer 12.

The term "video data" as used herein is data which has been compressed using a predetermined encoding scheme and is used to reproduce stereoscopic images. The audio data may be 2-channel, 5.1-channel or other multi-channel data. The audio data described hereinafter is assumed to be 2-channel data compressed using a predetermined encoding scheme.

The demultiplexer 12 splits the supplied multiplexed data into video data and audio data (e.g., 2-channel audio data). The demultiplexer 12 feeds the video data to the video-data decoder 13 and feeds the audio data to the audio-data decoder 16 as well.

The video-data decoder 13 decompresses the fed video data to decode it into the original video data and feeds it to the video-signal processor 14. The video-signal processor 14 converts the fed video data into analog data and performs predetermined signal processing to create video signals suitable for producing stereoscopic images. Then, the video signals are output to the three-dimensional display 21 through the video-signal interface 15.

The three-dimensional display 21 outputs video images corresponding to the output video signals on its display screen. The three-dimensional display 21 presents video images rich in depth that make the viewer feel close to or far away from objects in the video images or feel as if they are watching from different perspectives. The three-dimensional display 21 is a display device providing stereoscopic images by allowing each eye of the viewer to see a different image and may be used in conjunction with glasses having special optical characteristics, or may be used without them.

The audio-data decoder 16 decompresses the fed audio data to decode it into the original audio data and feeds the audio data to the audio-signal processor 17. The audio-signal processor 17 converts the fed audio data into analog audio data, performs predetermined signal processing and outputs the processed audio data to the speaker 22 through the audio-signal interface 18. The speaker 22 outputs a sound corresponding to the fed audio signal.

The system controller 19 is, for example, a microprocessor that controls the respective components in the reproduction apparatus 1. In particular, the system controller 19 transmits a predetermined control signal to the audio-signal processor 17 to control it. It should be noted that although the system controller 19 in FIG. 1 is connected to only the audio-signal processor 17 for convenience of illustration, the system controller 19 is actually connected to other components.

The operation-signal processor 20 receives an operation signal transmitted from the remote controller 23, demodulates the operation signal and feeds it to the system controller 19. The remote controller 23 includes input means, such as a button, a key and a touch panel, arranged thereon.

Although detailed descriptions will be made later, the audio-signal processor 17 extracts at least a high frequency component contained in an audio signal, defines it as a characteristic component Sc and supplies the audio signal and the extracted characteristic component Sc to the speaker 22 so as to localize a sound image of the extracted characteristic component Sc closer to a listener L than a sound image of the audio signal. This allows the reproduction apparatus 1 to provide sounds with auditory depth related to the depth of the stereoscopic video image.

[2. Structure of Audio-Signal Processing Device]

Referring now to FIGS. 3 to 7, audio-signal processing devices according to the first to fifth embodiments of the present invention will be described below. After items have been described once in an embodiment, they will not be further described in the other embodiments.

[2-1. First Embodiment]

Figure 3:
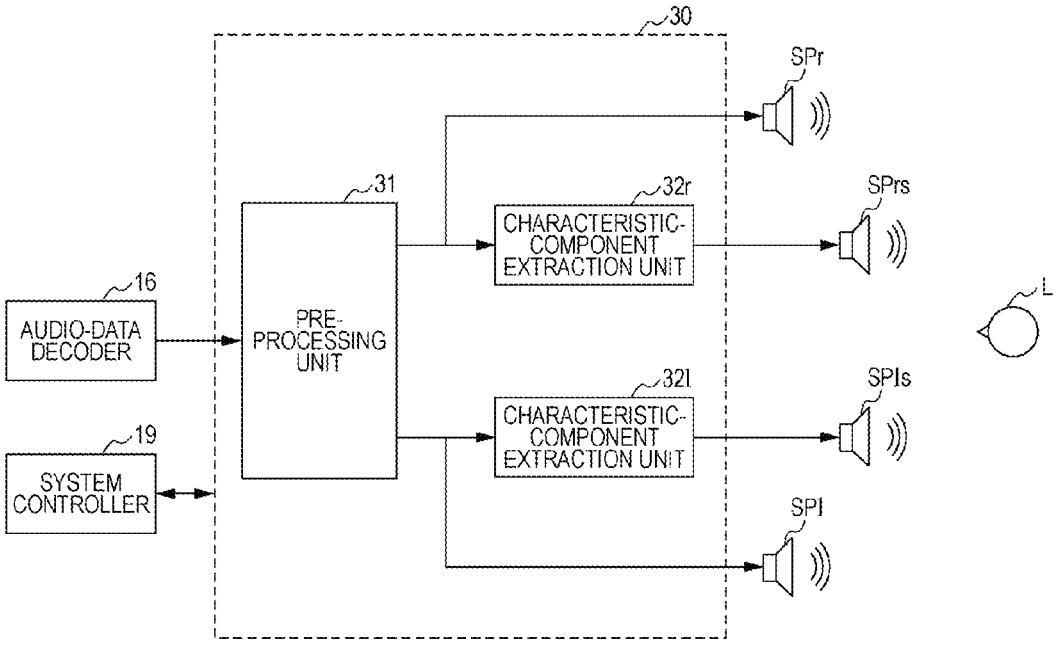
FIG. 3 is a block diagram illustrating an audio-signal processing device according to the first embodiment of the invention.

FIG. 3 is a block diagram illustrating an audio-signal processing device 30 according to the first embodiment of the invention. FIG. 3 illustrates the audio-signal processing device 30 (corresponding to the audio-signal processor 17 in FIG. 2) and peripheral components thereof.

The audio-signal processing device 30 is placed between an audio-data decoder 16 and a speaker set 22. The speaker set 22 includes left and right main speakers SPl, SPr and left and right sub-speakers SPls, SPrs that are arranged closer to a listener L than the left and right main speakers SPl, SPr.

The audio-signal processing device 30 includes a pre-processing unit 31, a left signal-processing system that processes audio signals for the left speaker SPl and a right signal-processing system that processes audio signals for the right speaker SPr. The left signal-processing system and right signal-processing system include characteristic-component extraction units 32*l* and 32*r*, respectively.

The pre-processing unit 31 generates audio signals for a left channel and right channel from the audio data supplied from the audio-data decoder 16 and feeds the signals to the left and right signal-processing systems, respectively. Since the left and right signal-processing systems perform the same processing, descriptions will be made about, in particular, the left signal-processing system.

The pre-processing unit 31 feeds an audio signal for the left channel to the characteristic-component extraction unit 32*l* in the left signal-processing system and to the left main speaker SPl. The characteristic-component extraction unit 32*l* including a filter, or the like, which permits audio signals in a specific frequency range to pass therethrough, extracts a characteristic component Sc contained in the fed audio signal and feeds the characteristic component Sc to the left sub-speaker SPl.

The characteristic component Sc contained in the audio signal is a signal component corresponding to a high frequency and low frequency sound, in particular a sound of high frequency in this embodiment. Such high and low frequency sounds dominate a large part of a sound Sf which has been recorded on-mic and is positioned in the foreground of a video image V. An audio signal can be divided into a midrange frequency component within a range of Q=1.5 to 2.0 with respect to 4 kHz, a low frequency component which is lower than the midrange frequency component and a high frequency component which is higher than the midrange frequency component.

In this manner, the audio signals are output from the main speakers SPl, SPr, while the characteristic components Sc are output from the sub-speakers SPls, SPrs, which are placed closer to the listener L than the main speakers SPl, SPr, thereby localizing the sound images of the characteristic components Sc closer to the listener L than the sound images of the audio signals.

According to the embodiment, the audio signals are output from the main speakers SPl, SPr, while the characteristic components Sc corresponding to high and low frequency sounds which are distinctive in the sound Sf recorded on-mic are extracted from the audio signals and then are output from the sub-speakers SPls, SPrs so that the sound images of the characteristic components Sc are localized closer to the listener L than the sound images of the audio signals, thereby providing sounds rich in auditory depth.

[2-2. Second Embodiment]

Figure 4:
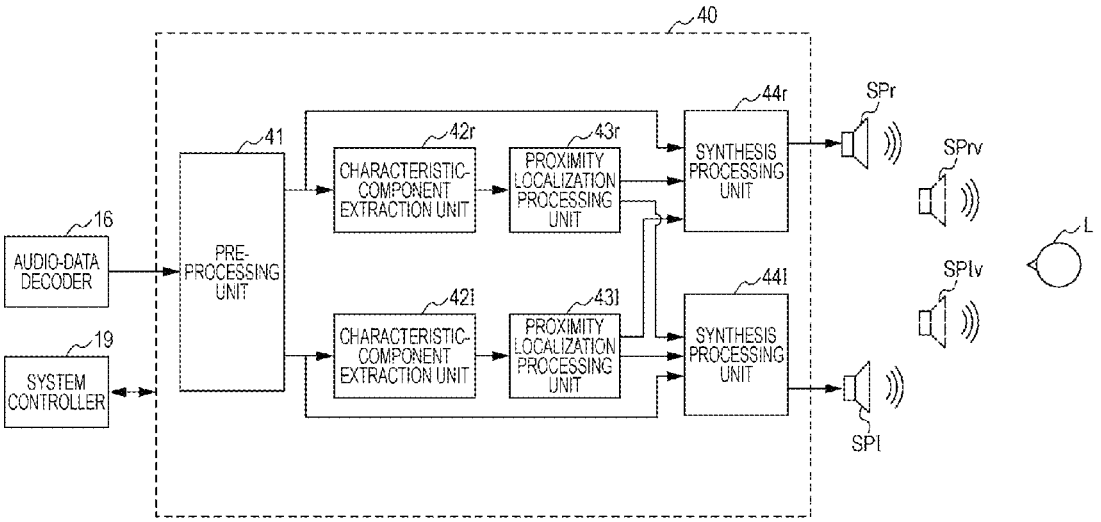
FIG. 4 is a block diagram illustrating an audio-signal processing device according to the second embodiment of the invention.

FIG. 4 is a block diagram illustrating an audio-signal processing device 40 according to the second embodiment of the present invention.

In this embodiment, a speaker set 22 includes left and right speakers SPl, SPr that also serve as virtual speakers SPlv, SPrv. The audio-signal processing device 40 includes proximity localization processing units 43*l*, 43*r* and synthesis processing units 44*l*, 44*r* in addition to a pre-processing unit 41 and characteristic-component extraction units 42*l*, 42*r*. The following description will cover, in particular, a left signal-processing system.

The pre-processing unit 41 supplies an audio signal for the left channel to the characteristic-component extraction unit 42*l* and synthesis processing unit 44*l* of the left signal-processing system. The characteristic-component extraction unit 42*l* extracts a characteristic component Sc contained in the supplied audio signal and feeds it to the proximity localization processing unit 43*l*.

The proximity localization processing unit 43*l* may be, for example, an equalizer that performs a proximity localization process involving alteration of the frequency response characteristic and/or sound level of the fed characteristic component Sc. Then, the proximity localization processing unit 43*l* feeds the processed characteristic component Sc to the synthesis processing units 44*l*, 44*r* in both the left and right signal processing systems.

In the proximity localization process, a sound-image localization control process is performed based on a head related transfer function or the like to localize the sound image of the characteristic component Sc closer to the listener L than the sound image of the audio signal.

The synthesis processing unit 44*l*, which may be, for example, a sound mixer, synthesizes the audio signals fed from the pre-processing unit 41 and the proximity localization processing units 43*l*, 43*r* of the left and right signal processing systems and supplies the synthesized audio signal to the left speaker SPl.

Adjusting the weight of the characteristic component Sc, which has been subjected to the proximity localization process, enables the sound image of the characteristic component Sc to be localized at a predetermined position which is closer to the listener L than the sound image of the audio signal.

In this manner, the audio signals are output from the speakers SPl, SPr, while the characteristic components Sc having been subjected to the proximity localization process are output from the virtual speakers SPlv, SPrv, thereby localizing the sound images of the characteristic components Sc closer to the listener L than the sound images of the audio signals.

According to the embodiment, the audio signals are output from the speakers SPl, SPr, while the characteristic components Sc corresponding to high and low frequency sounds, which are distinctive in the sound Sf recorded on-mic, are extracted from the audio signals, are subjected to the proximity localization process and are output from the virtual speakers SPlv, SPrv, thereby providing sounds rich in auditory depth without placement of sub-speakers.

[2-3. Third Embodiment]

Figure 5:
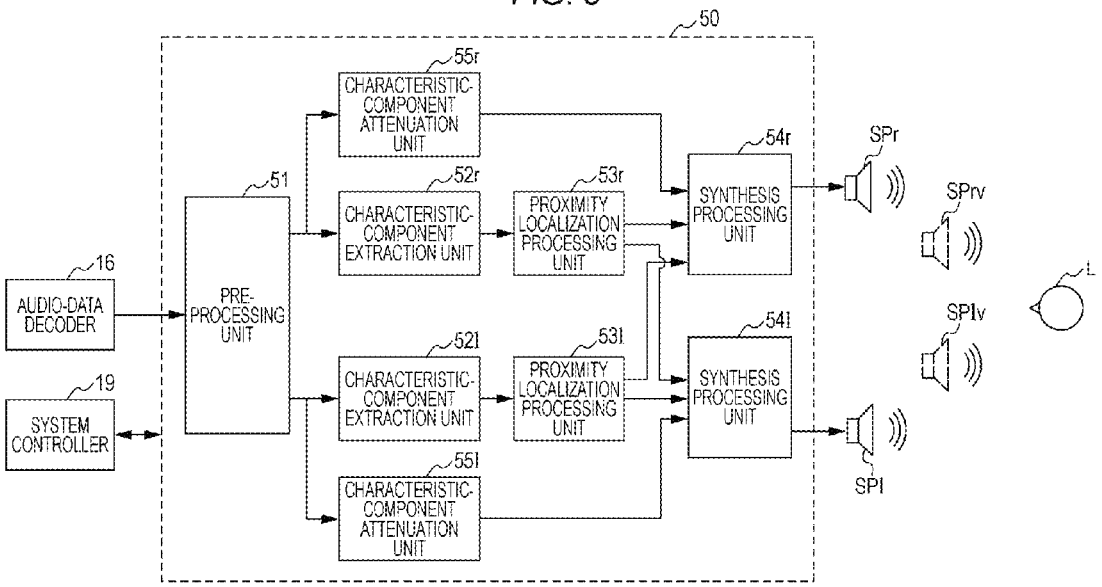
FIG. 5 is a block diagram illustrating an audio-signal processing device according to the third embodiment of the invention.

FIG. 5 is a block diagram of an audio-signal processing device 50 according to the third embodiment of the present invention.

In the embodiment, the audio-signal processing device 50 includes characteristic-component attenuation units 55*l*, 55*r* in addition to a pre-processing unit 51, characteristic-component extraction units 52*l*, 52*r*, proximity localization processing units 53*l*, 53*r* and synthesis processing units 54*l*, 54*r*. The following description will cover, in particular, a left signal-processing system.

The pre-processing unit 51 supplies an audio signal for the left channel to the characteristic-component extraction unit 52*l* and characteristic-component attenuation unit 55*l* of the left signal-processing system. The structure and operation of the characteristic-component extraction unit 52*l* and proximity localization processing unit 53*l* are the same as those of the characteristic-component extraction unit 42*l* and proximity localization processing unit 43*l* of the second embodiment and their descriptions will not be reiterated.

The characteristic-component attenuation unit 55*l*, which may be a filter or the like capable of attenuating audio signals in a specific frequency range, attenuates a characteristic component Sc contained in the supplied audio signal and feeds the attenuated audio signal (i.e., an audio signal with the attenuated characteristic component) to the synthesis processing unit 54*l*. The characteristic component Sc contained in the audio signal is a signal component corresponding to high and low frequency sounds, in particular a high frequency sound in this embodiment. Such high and low frequency sounds dominate a large part of a sound Sf which has been recorded on-mic and is positioned in the foreground of a video image V.

The synthesis processing unit 54*l* synthesizes the audio signals fed from the characteristic-component attenuation unit 55*l* and the proximity localization processing units 53*l*, 53*r* of the left and right signal processing systems and then feeds the synthesized audio signal to the left speaker SPl. The left speaker SPl outputs a sound corresponding to the attenuated audio signal as well as a sound corresponding to the characteristic component Sc that has been subjected to the proximity localization process.

In this manner, the audio signal with the attenuated characteristic component Sc is output from the speakers SPl, SPr, while the characteristic component Sc having been subjected to the proximity localization process is output from the virtual speakers SPlv, SPrv, thereby localizing the sound image of the characteristic component Sc closer to the listener L than the sound image of the audio signal and localizing the sound image of the audio signal with the attenuated characteristic component Sc further from the listener L than the sound image of the audio signal (the sound image of the audio signal is localized as a sound image of the attenuated audio signal). In other words, the attenuation of the characteristic component Sc can further enhance the depth presented by the sound image of the characteristic component Sc having been subjected to the proximity localization process and the sound image of the audio signal with the attenuated characteristic component Sc.

According to the embodiment, the audio signals whose characteristic components Sc have been attenuated are output from the speakers SPl, SPr, while the characteristic components Sc corresponding to high and low frequency sounds, which are distinctive in the sound Sf recorded on-mic, are extracted from the audio signals, are subjected to the proximity localization process and are output from the virtual speakers SPlv, SPrv, thereby providing sounds rich in auditory depth without placement of sub-speakers.

[2-4. Fourth Embodiment]

Figure 6:
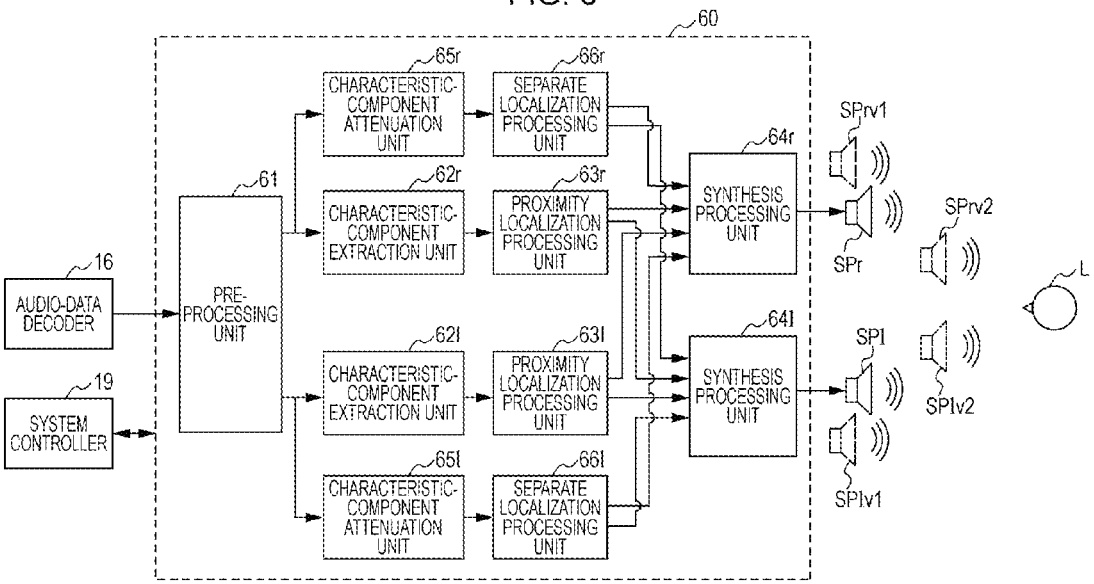
FIG. 6 is a block diagram illustrating an audio-signal processing device according to the fourth embodiment of the invention.

FIG. 6 is a block diagram illustrating an audio-signal processing device 60 according to the fourth embodiment of the present invention.

In this embodiment, the audio-signal processing device 60 includes separate localization processing units 66*l*, 66*r* in addition to a pre-processing unit 61, characteristic-component extraction units 62*l*, 62*r*, proximity localization processing units 63*l*, 63*r*, synthesis processing units 64*l*, 64*r* and characteristic-component attenuation units 65*l*, 65*r*. The following description will cover, in particular, a left signal-processing system.

The pre-processing unit 61 supplies an audio signal for the left channel to the characteristic-component extraction unit 62*l* and characteristic-component attenuation unit 65*l* of the left signal-processing system. The structure and operation of the characteristic-component extraction unit 62*l* and proximity localization processing unit 63*l* are the same as those of the characteristic-component extraction unit 42*l* and proximity localization processing unit 43*l* of the second embodiment and their descriptions will not be reiterated. The characteristic-component attenuation unit 65*l* attenuates the characteristic component Sc contained in the supplied audio signal and supplies the audio signal with the attenuated characteristic component Sc to the separate localization processing unit 66*l*.

The separate localization processing unit 66*l* performs a separate localization process that involves alteration of the frequency response, sound level of and/or time to feed the supplied audio signal with the attenuated characteristic component Sc. Then, the separate localization processing unit 66*l* feeds the processed audio signal to the synthesis processing units 64*l*, 64*r* of the left and right signal processing systems.

In the separate localization process, a sound-image localization control process is performed to the attenuated audio signal based on a head related transfer function or the like in order to lower the sound level of the characteristic component Sc and/or delay the time to feed the attenuated audio signal to the synthesis processing units 64*l*, 64*r*, thereby localizing the sound image of the attenuated audio signal further away from the listener L than the sound image of the audio signal. In particular, delaying output of the attenuated audio signal with respect to output of the characteristic component Sc causes the listener L to hear the sound corresponding to the audio signal as if the sound image of the characteristic component Sc is localized closer to the listener L than the sound image of the attenuated audio signal with Haas effect.

The synthesis processing unit 64*l* synthesizes the audio signals fed from the characteristic-component attenuation units 65*l*, 65*r* and proximity localization processing units 63*l*, 63*r* of the both left and right signal processing systems and feeds the synthesized audio signal to the left speaker SPl. The left speaker SPl outputs a sound corresponding to the audio signal having been subjected to the separate localization process as well as a sound corresponding to the characteristic component Sc having been subjected to the proximity localization process.

In this manner, the audio signal with the attenuated characteristic component Sc is subjected to the separate localization process and is output from the first virtual speaker SPlv1, while the characteristic component Sc is subjected to the proximity localization process and is output from the second virtual speaker SPlv2, thereby localizing the sound image of the characteristic component Sc closer to the listener L than the sound image of the audio signal and localizing the sound image of the attenuated audio signal further away from the listener L than the sound image of the audio signal (the sound image of the audio signal is localized as a sound image of the attenuated audio signal). In other words, performing the separate localization process on the audio signal with the attenuated characteristic component Sc can enhance the depth presented by the sound image of the characteristic component Sc having been subjected to the proximity localization process and the sound image of the audio signal having been subjected to the separate localization process.

According to the embodiment, the audio signals with the attenuated characteristic components Sc are subjected to the separate localization process and are output from the first virtual speakers SPlv1, SPrv1, while the characteristic components Sc corresponding to high and low frequency sounds, which are distinctive in the sound Sf recorded on-mic, are extracted from the audio signals, are subjected to the proximity localization process and are output from the second virtual speakers SPlv2, SPrv2, thereby providing sounds rich in auditory depth without placement of sub-speakers.

[2-5. Fifth Embodiment]

Figure 7:
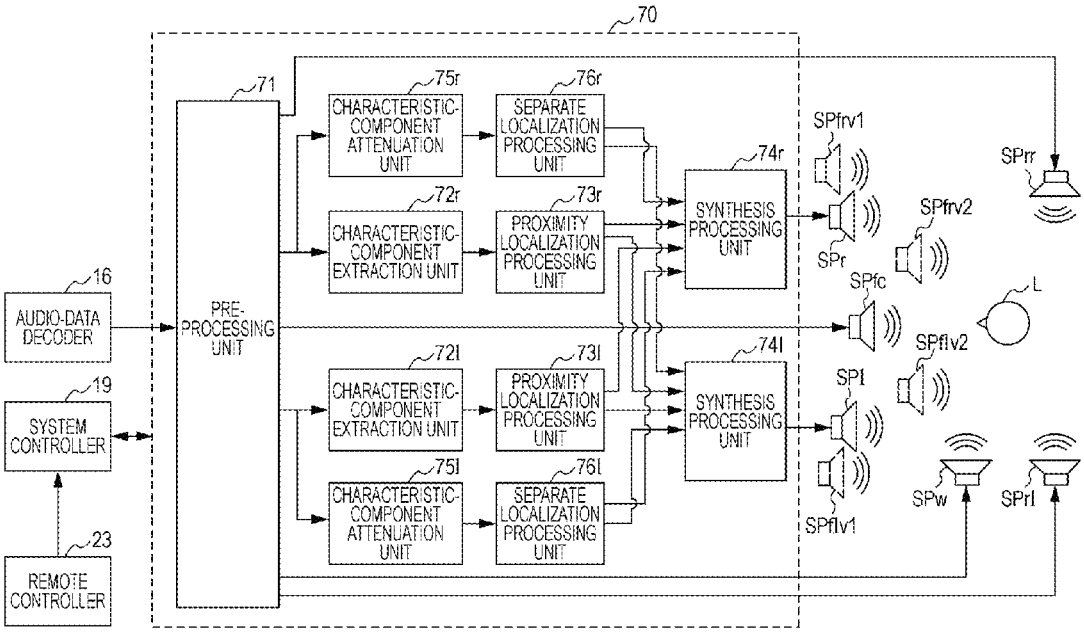
FIG. 7 is a block diagram illustrating an audio-signal processing device according to the fifth embodiment of the invention.

FIG. 7 is a block diagram illustrating an audio-signal processing device 70 according to the fifth embodiment of the present invention. In this embodiment, audio data is formatted to 5.1 channel data and a speaker set 22 includes a front left speaker SPfl, a front center speaker SPfc, a front right speaker SPfr, a rear left speaker SPrl, a rear right speaker SPrr and a woofer speaker SPw.

In this embodiment, when a listener L provides instructions for various settings with a remote controller 23, a system controller 19 transmits control signals that govern processing operations of each unit in the audio-signal processing device 70. Input of operation signals is made, for example, through an on-screen menu displayed on the remote controller 23, three-dimensional display 21 or the like.

The pre-processing unit 71 generates audio signals for respective channels, i.e., for the front left, front center, front right, rear left, rear right and woofer channels, from audio data supplied by the audio-data decoder 16 and feeds the generated audio signals to respective signal processing systems. The pre-processing unit 71 controls a switching element or other elements in response to a control signal to change the data to be supplied to the left signal-processing system and right signal-processing system.

If none of the extraction process, attenuation process and localization process are set to be carried out, the pre-processing unit 71 supplies data for the front left, front center, front right, rear left, rear right and woofer channels to the corresponding speakers SPfl, SPfc, SPfr, SPrl, SPrr and SPw, respectively.

On the other hand, if the extraction process, attenuation process or localization process is set to be carried out, the pre-processing unit 71 supplies data for the front center, rear left, rear right and woofer channels to the corresponding speakers SPfc, SPrl, SPrr and SPw and data for the front left and front right channels to the characteristic-component extraction units 72*l*, 72*r* and separate localization processing units 76*l*, 76*r* of the left signal-processing system and right signal-processing system, respectively.

Instead of supplying the front center channel data to the speaker SPfc at the front center, the pre-processing unit 71 can split the front center channel data into front left channel data and front right channel data and add them to the originally generated front left and front right channel data, respectively, and can send the front left and front right channel data to the characteristic-component extraction units 72*l*, 72*r* of the left and right signal-processing systems, respectively.

This split process is performed because, although the audio data for the rear left, rear right and woofer channels mainly contributes to auditory spatial perception, the audio data for the front left, front center and front right channels tends to provide flat auditory perception, and therefore, the localization process and other processes are preferable to enhance auditory depth perception.

Upon receipt of a control signal that is an instruction to adjust the settings of the extraction process, the characteristic-component extraction units 72*l*, 72*r* adjust the parameter of their own filters in response to the control signal to select a specific frequency range of an audio signal to be extracted as a characteristic component Sc. The control signal includes information, for example, indicating the necessity of the extraction process to extract a high and/or low frequency component or designating a specific frequency range.

Upon receipt of a control signal that is an instruction to adjust the settings of the proximity localization process, the proximity localization processing units 73*l*, 73*r* adjust the parameter of their own equalizers in response to the control signal to set the frequency response and/or sound level of the characteristic component Sc. The control signal includes information, for example, indicating the necessity of alteration of the frequency response and/or sound level or designating a condition for altering the frequency response and/or sound level.

Upon receipt of a control signal that is an instruction to adjust the settings of the attenuation process, the characteristic-component attenuation units 75*l*, 75*r* adjust the parameter of their own filters in response to the control signal to select a specific frequency range of an audio signal to be attenuated as a characteristic component Sc. The control signal includes information, for example, indicating the necessity of the attenuation process for the high and/or low frequency component or designating a specific frequency range.

Upon receipt of a control signal that is an instruction to adjust the settings of the separate localization process, the separate localization processing units 76*l*, 76*r* adjust the parameter of their own equalizers in response to the control signal and alter the frequency response, sound level and/or amount of delay of the characteristic component Sc. The control signal includes information, for example, indicating the necessity of alteration of the frequency response, sound level and/or amount of delay or designating conditions for altering the frequency response, sound level and/or amount of delay.

Upon receipt of a control signal that is an instruction to adjust the settings of the synthesis process, the synthesis processing units 74*l*, 74*r* adjust the parameter of their own sound mixers in response to the control signal and change conditions for synthesizing the signal components localized in the proximity and/or at a distance in each signal processing system and conditions for synthesizing the signal components having been subjected to the extraction process and/or attenuation process. The control signal includes information, for example, indicating the necessity of synthesis of the components or designating synthesis conditions such as weights for each component.

Thus, the embodiment can provide sounds with desirably adjusted auditory depth in accordance with the listener L's customized settings of the characteristic-component extraction process, proximity localization process, characteristic-component attenuation process, separate localization process and synthesis process.

Having described the preferred embodiments of the invention with reference to the accompanying drawings, it is to be understood that the invention is not limited to those precise embodiments. Various changes and modifications within the technical ideas cited in the scope of the appended claims will come to mind of those skilled in the art to which this invention pertains, and which should be understood to be covered by the technical scope of the invention.

For example, the above-described embodiments state that the 2-channel audio data is output from the 2-channel speakers SPl, SPr, however, for example, 5.1-channel, 7.1-channel or monaural audio data can be output from speakers for 2 channels, 5.1 channels, 7.1 channels or the like.

Suppose 5.1-channel or 7.1-channel audio data is output from 2-channel speakers, the audio data of the front 3 channels among the 5.1 channels or 7.1 channels are split into left channel data and right channel data, are subjected to an extraction process for extracting a characteristic component Sc, a proximity localization process, an attenuation process for attenuating the audio signal, and a separate localization process in the left and right signal processing systems, and are output from the 2-channel speakers. Output of monaural audio data from 2-channel speakers can be carried out by splitting the monaural data into left channel data and right channel data and outputting them in the same manner.

Although the characteristic-component extraction units 42, 52, 62, 72 and proximity localization processing units 43, 53, 63, 73 are individual components in the above-described second to fifth embodiments, the characteristic-component extraction units 42, 52, 62, 72 and proximity localization processing units 43, 53, 63, 73 can be integrated like an equalizer with a filtering function. The same can be applied to the characteristic-component attenuation units 65, 75 and separate localization processing units 66, 76 described in the fourth and fifth embodiments.

Although the synthesis processing units 44, 54, 64, 74 are provided to both the left and right signal processing systems in the second to the fifth embodiments, the synthesis processing units 44, 54, 64, 74 can be designed so as to be shared by the left and right signal processing systems.

Although the fifth embodiment describes controls of the processing operations performed by the respective units of the audio-signal processing device 60 in the fourth embodiment, the processing operations performed by the units in the audio-signal processing devices 30, 40, 50 in the first to the third embodiments can be also designed to be controllable.

The present application contains subject matter related to that disclosed in Japanese Priority Patent Application JP 2009-197000 filed in the Japan Patent Office on Aug. 27, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An audio-signal processing device configured to process an audio signal including sound recorded from a first sound source and a second sound source and supply output signals to an audio output unit, wherein the audio-signal processing device comprises:

a characteristic-component extraction unit configured to extract a high frequency component and a low frequency component contained in the audio signal as a characteristic component representative of the first sound source located closer to a recording microphone than the second sound source, wherein the audio signal and the extracted characteristic component are supplied to the audio output unit so that a sound image produced from the extracted characteristic component is localized closer to a listener and emanates simultaneously from a first pair of speakers that are located closer to listener than a sound image produced from the audio signal by second speakers.

2. The audio-signal processing device according to claim 1, further comprising:

a proximity localization processing unit configured to perform a proximity localization process on the extracted characteristic component to localize the sound image of the extracted characteristic component closer to the listener than the sound image of the audio signal, wherein the characteristic component having been subjected to the proximity localization process is supplied to the audio output unit.

3. The audio-signal processing device according to claim 1, further comprising:

a characteristic-component attenuation unit configured to attenuate the characteristic component contained in the audio signal, wherein the attenuated audio signal and the extracted characteristic component are supplied to the audio output unit so that the sound image of the extracted characteristic component is localized closer to the listener than the sound image of the audio signal and a sound image of the attenuated audio signal is localized further away from the listener than the sound image of the audio signal.

4. The audio-signal processing device according to claim 3, further comprising:

a separate localization processing unit configured to perform a separate localization process on the attenuated audio signal to localize the sound image of the attenuated audio signal further away from the listener than the sound image of the audio signal, wherein the audio signal having been subjected to the separate localization process is supplied to the audio output unit instead of the attenuated audio signal.

5. The audio-signal processing device according to claim 4, wherein the separate localization processing unit is further configured to delay the attenuated audio signal by a predetermined amount of time with respect to the audio signal.

6. The audio-signal processing device according to claim 1, further comprising a variable control configured to set a condition for extracting the characteristic component responsive to an operating instruction made by the listener.

7. The audio-signal processing device according to claim 2, further comprising a variable control configured to set a condition of the proximity localization process for the characteristic component responsive to an operating instruction made by the listener.

8. The audio-signal processing device according to claim 3, further comprising a variable control configured to set a condition for attenuating the audio signal responsive to an operating instruction made by the listener.

9. The audio-signal processing device according to claim 4, further comprising a variable control configured to set a condition of the separate localization process for the audio signal responsive to an operating instruction made by the listener.

10. The audio-signal processing device according to claim 1, wherein the audio-signal processing device is configured to receive a multi-channel signal as the audio signal, and further comprises a variable control configured such that a signal of a channel designated by the listener is input to the characteristic-component extraction unit.

11. The audio-signal processing device according to claim 1, wherein the characteristic component is representative of a person's dialogue in a video.

12. The audio-signal processing device according to claim 1, wherein the characteristic component comprises frequencies higher than a midrange frequency component, wherein the midrange frequency component is within a range of Q=1.5 to 2.0 with respect to 4 kHz.

13. A method for processing an audio signal that includes sound recorded from a first sound source and a second sound source, the method comprising:

extracting a high frequency component and a low frequency component from the audio signal as a characteristic component representative of the first sound source located closer to a recording microphone than the second sound source;

supplying the audio signal and the extracted characteristic component to an audio output Unit;

producing a first sound image from the extracted characteristic component with first speakers;

producing a second sound image from the audio signal with second speakers; and localizing the first sound image closer to a listener with the first speakers than the second sound image, wherein the first speakers are closer to the listener than the second speakers.

14. The method of claim 13, wherein the first speakers are virtual speakers.

15. The method of claim 13, further comprising demultiplexing the audio signal from multiplexed audio and video data.

16. The method of claim 15, further comprising producing video signals suitable for stereoscopic images from the video data.

17. The audio-signal processing device of claim 1, wherein the first pair of speakers are virtual speakers.

18. The audio-signal processing device of claim 1, further comprising:

a demultiplexor configured to demultiplex the audio signal and a video signal from multiplexed audio and video data; and a video signal processor configured to produce video signals suitable for stereoscopic images from the video data.

* * * * *